US012746639B2

(12) United States Patent
He et al.

(10) Patent No.: US 12,746,639 B2
(45) Date of Patent: Sep. 29, 2026

(54) POLISHING PAD CONDITIONING APPARATUS

(71) Applicant: HANGZHOU SIZONE ELECTRONIC TECHNOLOGY INC., Zhejiang (CN)

(72) Inventors: Hongxiu He, Zhejiang (CN); Yuansi Yang, Zhejiang (CN); Zhipeng Zhou, Zhejiang (CN)

(73) Assignee: HANGZHOU SIZONE ELECTRONIC TECHNOLOGY INC., Zhejiang (CN)

( * ) Notice: Subject to any disclaimer, the term of this patent is extended or adjusted under 35 U.S.C. 154(b) by 302 days.

(21) Appl. No.: 18/726,125

(22) PCT Filed: Dec. 30, 2022

(86) PCT No.: PCT/CN2022/144028

§ 371 (c)(1),
(2) Date: Jul. 2, 2024

(87) PCT Pub. No.: WO2023/131075

PCT Pub. Date: Jul. 13, 2023

(65) Prior Publication Data

US 2025/0065472 A1 Feb. 27, 2025

(30) Foreign Application Priority Data

Jan. 5, 2022 (CN) ..... 202210004130.7

(51) Int. Cl.
*B24B 53/017* (2012.01)
*B24B 53/007* (2006.01)

(52) U.S. Cl.
CPC ..... *B24B 53/017* (2013.01); *B24B 53/007* (2013.01)

(58) Field of Classification Search
CPC ..... B24B 53/00; B24B 53/007; B24B 53/017
See application file for complete search history.

(56) References Cited

U.S. PATENT DOCUMENTS 6,517,414 B1 * 2/2003 Tobin ..... B24B 49/16 451/21
2003/0092357 A1 * 5/2003 Yoon ..... B24B 53/017 451/2

FOREIGN PATENT DOCUMENTS

CN 101623849 1/2010
CN 107350961 11/2017
(Continued)

OTHER PUBLICATIONS

"International Search Report (Form PCT/ISA/210) of PCT/CN2022/144028", mailed on Mar. 17, 2023, with English translation thereof, pp. 1-4.

*Primary Examiner* — C. A. Rivera
(74) *Attorney, Agent, or Firm* — JCIPRNET

(57) ABSTRACT

Disclosed in the present invention is a polishing pad conditioning apparatus, comprising: a connecting arm that horizontally extends; a finishing head unit, provided at one end of the connecting arm and used for finishing a polishing pad; and a base unit, provided at the other end of the connecting arm, movably connected to the connecting arm, and used for driving the connecting arm to drive the finishing head unit to vertically move up and down, so that the finishing head unit is close to or far away from the polishing pad in a direction tending to be perpendicular to the polishing pad. The present invention can stably achieve uniform and stable positive pressure in a finishing process and ensure the consistency of a polishing finishing process.

17 Claims, 4 Drawing Sheets

(56) References Cited

FOREIGN PATENT DOCUMENTS

| | | | |
|---|---|---|---|
| CN | 108453618 | | 8/2018 |
| CN | 114012605 | | 2/2022 |
| JP | H10217102 | | 8/1998 |
| JP | H10217102 A | * | 8/1998 |
| JP | H11114803 | | 4/1999 |

* cited by examiner

POLISHING PAD CONDITIONING APPARATUS

CROSS-REFERENCE TO RELATED APPLICATION

This application is a 371 of international application of PCT application serial no. PCT/CN2022/144028, filed on Dec. 30, 2022, which claims the priority benefit of China application no. 202210004130.7, filed on Jan. 5, 2022. The entirety of each of the above-mentioned patent applications is hereby incorporated by reference herein and made a part of this specification.

TECHNICAL FIELD

The present invention belongs to the field of fabrication of semiconductor integrated circuit chips, and particularly relates to a polishing pad conditioning apparatus.

DESCRIPTION OF RELATED ART

In chemical mechanical planarization (CMP) equipment, wafers are polished on a rough surface of a polishing pad. With the increase of the polishing time, the surface of the polishing pad will be worn down and cannot be used for polishing anymore. In this case, the surface of the polishing pad needs to be processed with a conditioning device provided with a diamond grinding wheel until the surface of the polishing pad gets rough and has friction, such that the polishing pad can function for polishing again.

To complete the entire polishing process, the polishing pad conditioning device needs to approach the polishing pad in the height direction. At present, such an UP/Down process of existing polishing pad conditioning devices is implemented based on the lever principle, and a power device by controlling the short arm of force of the lever to realize the movement of the long arm of force on the other side, as shown in FIG. 1, thus implementing the UP/Down process of a finishing head of the polishing pad conditioning devices Such a method has the following defects: first, in the abrasion process of the polishing pad, the space angle a of a mechanical arm supporting the polishing pad conditioning device changes constantly due to the change of the height of the polishing pad, that is, the direction F2 of a pressure applied to the polishing pad by the polishing pad conditioning device changes constantly, so the finished polishing pad cannot be maintained in a relatively stable state, making it impossible to guarantee the consistency of wafers polished on the polishing pad; second, because of the characteristic of the lever principle, the space angle a is not zero in most cases, the pressure applied to the polishing pad by the polishing pad conditioning device is not a positive pressure in most cases, that is, the polishing pressures in different areas of the polishing pad conditioning device are inconsistent, and the swing speed of the polishing pad conditioning device during operation is limited, as a result, different areas of the polishing pad will be finished to different degrees, that is, the consistency in shape of the polishing pad cannot be guaranteed, compromising the consistency of polished wafers; in addition, the lever principle implements the UP/Down process actually by means of a motion amplification mechanism, which amplifies the displacement of the power device to drive the head of the polishing pad conditioning device to move, but the stability of the spatial position of the polishing pad conditioning device is greatly reduced, and fluctuations of the power device are easily amplified and transmitted to the finishing head of the polishing pad conditioning device, as a result, the motion impact will be amplified when the polishing pad conditioning device approaches the polishing pad, making the polishing pad more likely to be damaged by impact; finally, rigid limits need to be set at UP/Down limit positions of the polishing pad conditioning device in the UP/Down process, and errors of the rigid limits in the machining, installation and debugging process will be amplified by the lever mechanism, making it impossible to guarantee the consistency of different working stations of the polishing pad conditioning device.

SUMMARY OF THE INVENTION

To overcome the defects in the prior art, the present invention provides a polishing pad conditioning apparatus, which makes a power direction consistent with a motion direction to allow a connecting arm to drive a finishing head unit to horizontally finish a polishing pad so as to achieve a more uniform finishing pressure.

The technical solution adopted by the present invention to solve the technical problems is as follows: a polishing pad conditioning apparatus comprises:

- a connecting arm extending horizontally;
- a finishing head unit arranged at one end of the connecting arm and used for finishing a polishing pad; and
- a base unit arranged at the other end of the connecting arm, movably connected to the connecting arm and used for driving the connecting arm to drive the finishing head unit to vertically move up and down, so that the finishing head unit is close to or far away from the polishing pad in a direction tending to be perpendicular to the polishing pad.

In the invention, the base unit is used for driving the connecting arm to vertically move up and down to drive the finishing head unit to finish the polishing head vertically downward, thus keeping the power direction consistent with the motion direction; the finishing head unit is horizontally driven to move up and down to achieve a uniform and stable polishing pressure in the finishing process, thus solving the problem that the pressure applied to the polishing pad by the polishing head unit based on the lever principle in the prior art changes constantly; and the acting force is not amplified, thus guaranteeing the consistency in shape of the polishing pad.

Further, the connecting arm horizontally drives the finishing head unit to vertically move up and down.

Further, the finishing head unit vertically moves up and down to be in surface contact with the polishing pad and keeps in surface contact with the polishing pad to finish the polishing pad.

Further, the base unit at least comprises:

- a mounting base;
- a connector capable of vertically moving up and down with respect to the mounting base and connected to the connecting arm; and
- a movable connecting plate connected to the connecting arm and driven by the connecting arm to vertically move up and down along the mounting base.

The movable connecting plate can withstand a bending moment caused by the finishing head unit and the connecting arm, thus guaranteeing the stability of the whole structure.

Further, the base unit further comprises an adjusting assembly, the adjusting assembly penetrates through the connecting arm to abut against a top surface of the movable connecting plate to adjust a clearance between the connecting arm and the movable connecting plate so as keep the connecting plate horizontal.

Further, the adjusting assembly comprises at least two first adjusting pieces, the first adjusting pieces are arranged at intervals in a length direction of the connecting arm, and the at least two first adjusting pieces work together to form a first angle between the connecting arm and the movable connecting plate to prevent the connecting arm from inclining upward in the length direction.

Further, the adjusting assembly further comprises at least two second adjusting pieces, the second adjusting pieces are arranged at intervals in a width direction of the connecting arm, and the at least second adjusting pieces work together to form a second angle between the connecting arm and the movable connecting plate to prevent the connecting arm from inclining upward in the width direction.

Further, the first adjusting pieces and the second adjusting pieces are arranged perpendicularly.

Further, a total number of the first adjusting pieces and the second adjusting pieces is six, and the first adjusting pieces and the second adjusting pieces are divided in two groups which are symmetrically arranged with respect to a central axis of the connecting arm.

Further, the connecting arm and the movable connecting plate are connected by means of fasteners, and the fasteners are close to the first adjusting pieces and the second adjusting pieces.

Further, a guide mechanism extending vertically is arranged on the mounting base, and the movable connecting plate vertically moves up and down along the guide mechanism.

Further, the guide mechanism and the finishing head unit are arranged on two sides of the mounting base respectively. The finishing head unit, the connector and the guide mechanism are sequentially arranged from left to right, and the connector is arranged between the finishing head unit and the guide mechanism. In the operating process, the thrust applied to the connector by the power mechanism can overcome to some extent the bending moment of the guide mechanism caused by the finishing head unit to reduce a load of the guide mechanism, thus prolonging the service life of the guide mechanism.

Further, stop blocks are formed at upper and lower ends of the guide mechanism respectively to limit upward and downward moving distances of the movable connecting plate. The stop blocks fulfill a limiting effect in the entire UP/Down process to guarantee a safe operating range of the finishing head unit.

Further, the connector and the movable connecting plate are arranged separately; or, the connector and the movable connecting plate are configured as an integrated structure.

Further, the connector is driven by a power mechanism to move up and down, and a motion clearance is formed between the connector and the power mechanism;

or, the connector and the power mechanism are connected integrally.

The motion clearance can fulfill a protection effect between the connector and the power mechanism and improve the flexibility of the connector and the power mechanism; and by connecting the connector and the power mechanism integrally, the overall structure is simpler.

Further, the power mechanism is a cylinder.

Further, a cover having a bottom provided with an opening is formed at an end of the connecting arm, and the connector and the movable connecting plate are connected to an inner top surface of the cover; and hollow portions are formed in a top surface of the cover.

Further, the finishing head unit comprises a driving unit and a finishing blade.

Further, the base unit is connected to a swing unit, and the swing unit is connected to a fixing seat and used for driving the base unit, the connecting arm and the finishing head unit to swing circumferentially as a whole.

The present invention has the following merits: (1) compared with an prior rotary UP/Down structure, the horizontal UP/Down structure can stably achieve a uniform and stable positive pressure during the finishing process, thus guaranteeing the consistency of the polishing finishing process: (2) compared with the prior rotary UP/Down structure, the horizontal UP/Down structure is not a motion amplification structure and can effectively reduce the impact effect of the finishing head unit on the polishing pad in the process of moving to the polishing pad; and (3) compared with the prior rotary UP/Down structure, the horizontal UP/Down structure does not have an amplification effect on positional errors of rigid limit structures, so that the consistency of the working station state of the finishing head unit is more easily ensured.

DETAILED DESCRIPTION OF THE EMBODIMENTS

To allow those skilled in the art to gain a better understanding of the technical solutions of the present invention, the technical solutions in the embodiments of the present invention will be clearly and completely described below in conjunction with accompanying drawings of these embodiments. Obviously, the embodiments described below are merely illustrative ones, and are not all possible ones of the present invention. All other embodiments obtained by those ordinarily skilled in the art based on the following ones without creative labor should also fall within the protection scope of the present invention.

Figure 1:
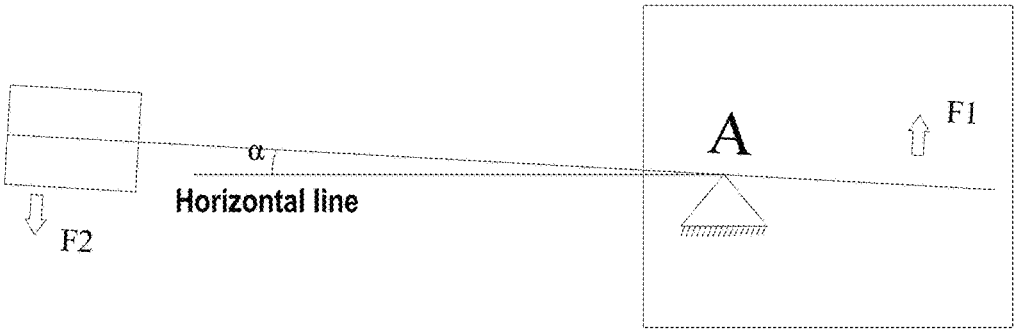
FIG. 1 (Prior Art)
FIG. 1 is a schematic diagram of a mechanism of action in the prior art where a finishing head unit moves up and down with A as fulcrum.
Figure 2:
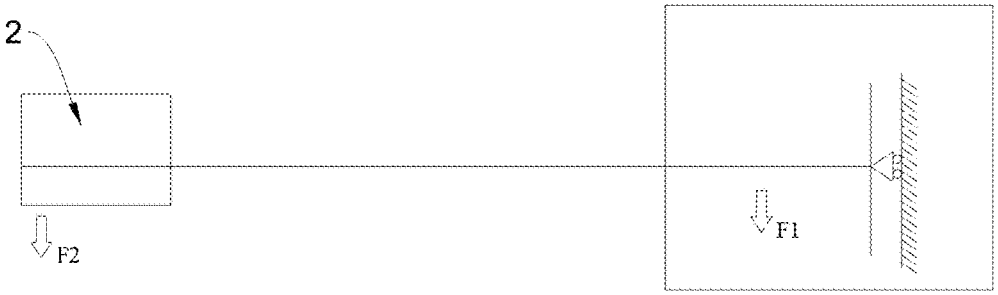
FIG. 2 is schematic diagram of a mechanism of action of the present invention where a finishing head unit is horizontally driven to move up and down.
Figure 3:
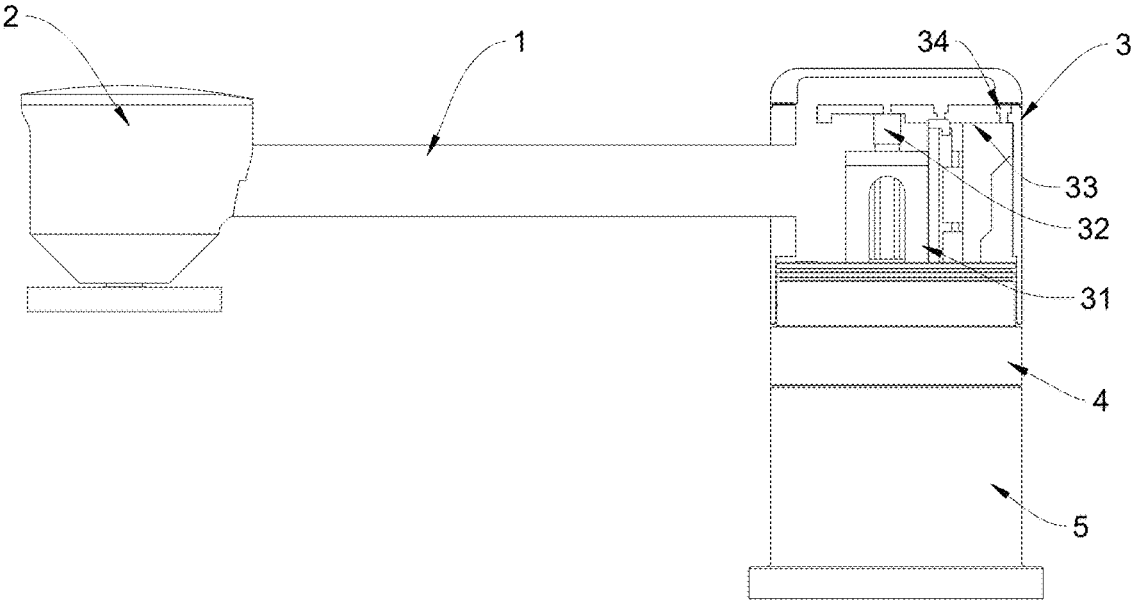
FIG. 3 is a schematic structural diagram of the present invention.

As shown in FIG. 2-FIG. 3, a polishing pad conditioning apparatus comprises a connecting arm 1 that horizontally extends, a finishing head unit 2 arranged at one end of the connecting arm 1 and used for finishing a polishing pad, and a base unit 2 arranged at the other end of the connecting arm 1, movably connected to the connecting arm 1 and used for driving the connecting arm 1 to drive the finishing head unit 2 to vertically move up and down, so that the finishing head unit 2 is close to or far away from the polishing pad in a direction tending to be perpendicular to the polishing pad, that is to say, the finishing head unit 2 is close to or far away from the polishing pad in a direction perpendicular to the polishing pad. The finishing head unit 2 moves up or down to be in surface contact with the polishing pad and keeps in surface contact with the polishing pad in the entire finishing process, that is, the finishing head unit keeps in surface contact with the polishing pad until the polishing pad is finished.

The connecting arm 1 horizontally drives the finishing head unit 2 to vertically move up and down, that is, the connecting arm 1 will not incline when moving up and down.

Figure 4:
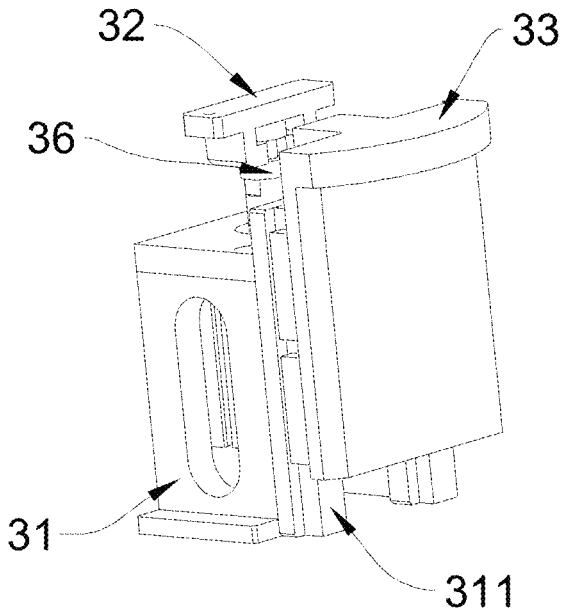
FIG. 4 is a first three-dimensional view of a base unit according to the present invention.
Figure 5:
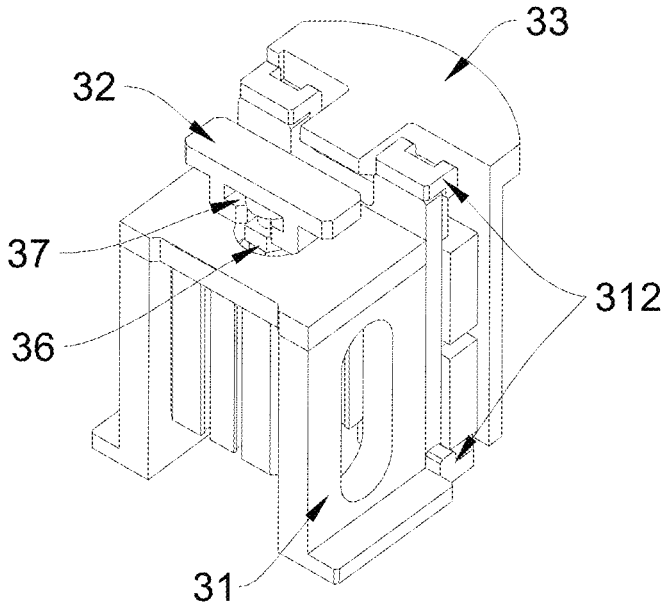
FIG. 5 is a second three-dimensional view of the base unit according to the present invention.

As shown in FIG. 4 and FIG. 5, the base unit 3 comprises a mounting base 31, a connector 32, a movable connecting plate 33 and an adjusting assembly 34.

The mounting base 31 is fixed relatively, used for mounting and fixing other parts and formed by an integrated part, such that installation errors caused by installation of multiple parts are avoided, thus guaranteeing the accuracy of the finishing head unit 2 in the operating process.

The connector 32 is fixedly connected to the connecting arm 1 with bolts and is able to vertically move up and down with respect to the mounting base 31, that is, the connector 21 drives the connecting arm 1 to vertically move up and down.

The connector 32 is driven by a power mechanism 36 to move up and down, a motion clearance 37 is formed between the connector 32 and the power mechanism 36, and as shown in FIG. 5, the motion clearance 37 comprises a horizontal motion clearance, a vertical motion clearance and a circumferential rotational motion clearance. In this embodiment, the power mechanism 36 is a cylinder, which is vertically mounted to drive the connector 32 to vertically move up and down. Of course, the connector 32 and the power mechanism 36 may also be configured as an integrated structure.

The movable connecting plate 33 is connected to the connecting arm 1. Specifically, the movable connecting plate 33 is connected to the bottom of the connecting arm 1 and driven by the connecting arm 1 to vertically move up and down along the mounting base 31.

The movable connecting plate 33 and the connector 32 are arranged separately or connected integrally.

To guarantee that the movable connecting plate 33 can vertically move up and down, a guide mechanism 311 that vertically extends is arranged on the mounting base 31, and the movable connecting plate 33 vertically moves up and down along the guide mechanism 311. To prevent the movable connecting plate 33 from being separated from the guide mechanism 311, stop blocks 312 are formed at upper and lower ends of the guide mechanism 311 respectively to limit upward and downward moving distances of the movable connecting plate 33. In this embodiment, the guide mechanism 311 is configured as a parallel dual-rail four-slider structure to guarantee stability and strength.

The guide mechanism 311 and the finishing head unit 2 are arranged on two sides of the mounting base 31 respectively, that is, the finishing head unit 2, the connector 32 and the guide mechanism 311 are sequentially arranged from left to right.

The adjusting assembly 34 penetrates through the connecting arm 1 to abut against a top surface of the movable connecting plate 33, such that the clearance between the connecting arm 1 and the movable connecting plate 33 can be adjusted to keep the connecting arm 1 horizontal. Of course, in an ideal condition, the connecting arm 1 can also be kept horizontal under the precondition that the machining accuracy of workpieces is guaranteed, and in this case, the adjusting assembly 34 can be omitted.

Figure 6:
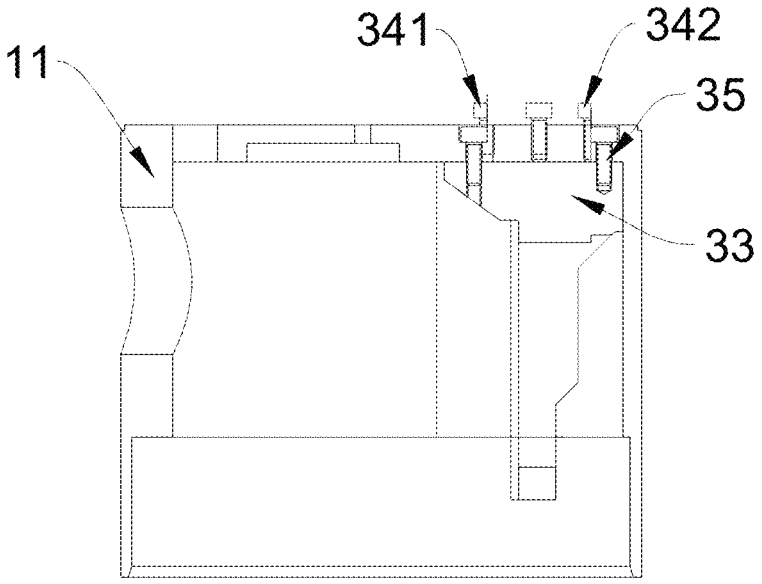
FIG. 6 is a partial perspective view of the base unit according to the present invention.
Figure 7:
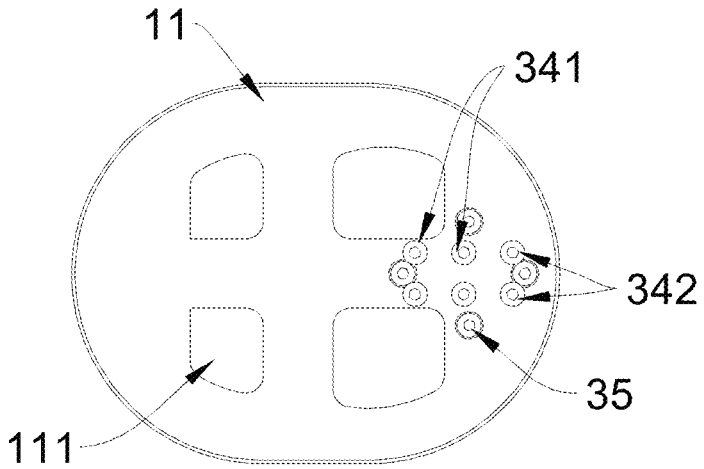
FIG. 7 is a top view of the base unit according to the present invention.
Figure 8:
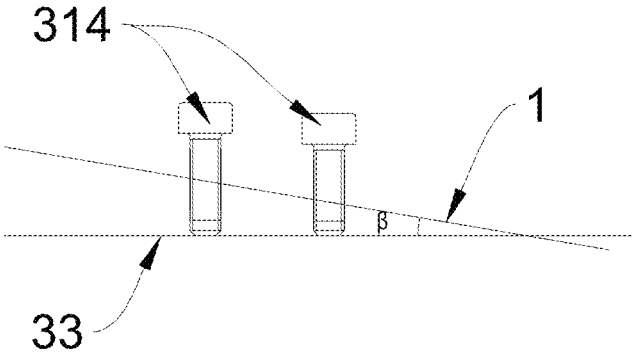
FIG. 8 is a schematic diagram of the operating principle of first adjusting pieces according to the present invention.

Specifically, as shown in FIG. 6 and FIG. 7, the adjusting assembly 34 comprises at least two first adjusting pieces 341, the first adjusting pieces 341 are arranged at intervals in a length direction of the connecting arm 1 and preferably located on a central axis of the connecting arm 1. In this way, the at least two first adjusting pieces 341 work together to form a first angle between the connecting arm 1 and the movable connecting plate 33 to prevent the connecting arm 1 from inclining in the length direction. Taking the angle N in FIG. 8 as the first angle and the direction shown in FIG. 2 as an example, the connecting arm 1 tends to rotate anticlockwise under the action of self weight, and at this moment, the first adjusting pieces 341 can be rotated downward to abut against the top surface of the movable connecting plate 33 to allow the right end of the connecting arm 1 to drive the left end of the connecting arm 1 to tilt upward, such that the connecting arm 1 will not incline under the action of self weight, that is, the connecting arm 1 is prevented from inclining in the length direction, thus keeping the connecting arm 1 horizontal in the axial direction.

The adjusting assembly 34 further comprises at least two second adjusting pieces 342, and the second adjusting pieces 342 are arranged at intervals in a width direction of the connecting arm 1 and preferably located on a horizontal line in the width direction of the connecting arm 1, such that the at least two second adjusting pieces 342 work together to form a second angle between the connecting arm 1 and the movable connecting plate 33 to prevent the connecting arm 1 from inclining upward in the width direction. The specific principle in the width direction is the same as the principle in the length direction and will not be repeated here.

To facilitate adjustment and keep the connecting arm 1 horizontal by means of the first adjusting pieces 341 and the second adjusting pieces 342, the first adjusting pieces 341 and the second adjusting pieces 342 are arranged perpendicularly, that is, a line of centers of all the first adjusting pieces 241 is perpendicular to a line of centers of the all the second adjusting pieces 342.

In this embodiment, as shown in FIG. 7, the total number of the first adjusting pieces 341 and the second adjusting pieces 342 is six, the first adjusting pieces 341 and the second adjusting pieces 342 are divided into two groups which are symmetrically arranged with respect to the central axis of the connecting arm 1, each group includes three adjusting pieces, and in this case, there is no distinct demarcation between the first adjusting pieces 341 and the second adjusting pieces 342, part of the adjusting pieces function as the first adjusting pieces 341 for adjusting the state of the connecting arm 1 in the length direction, and the other part of the adjusting pieces function as the second adjusting pieces 342 for adjusting the state of the connecting arm 1 in the width direction.

The connecting arm 1 and the movable connecting plate 33 are connected by means of fasteners 35, and the fasteners 35 are arranged close to the first adjusting pieces 341 and the second adjusting pieces 342. In this embodiment, four fasteners 35 are used and arranged on the periphery of the adjusting assembly 34. During specific assembly, the adjusting assembly 34 is assembled first, and then the fasteners 35 are assembled.

A cover 11 with the bottom provided with an opening is formed at an end of the connecting arm 1, and the connector 32 and the movable connecting plate 33 are connected to an inner top surface of the cover 11, so that the connector 32, the movable connecting plate 33, the mounting base 31, the power mechanism 36 and the guide mechanism 311 are all covered by the cover 11; and a hollow portions 111 are formed in a top surface of the cover 11 to reduce the weight of the connecting arm 1.

Figure 9:
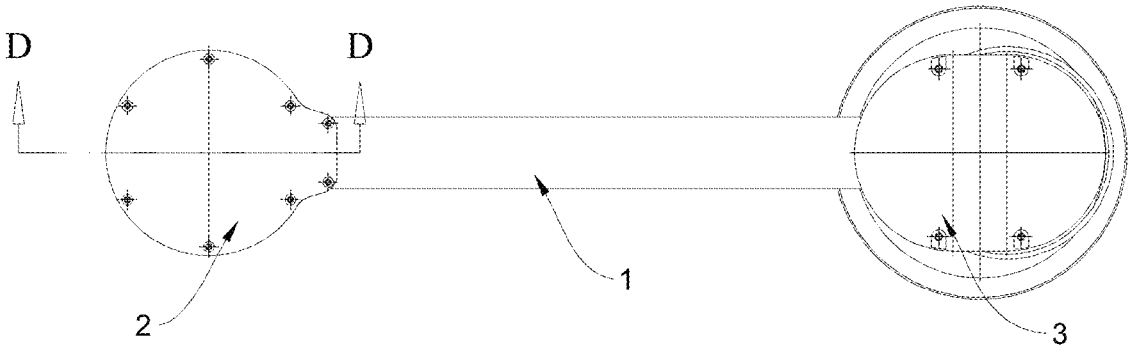
FIG. 9 is a top view of the present invention.
Figure 10:
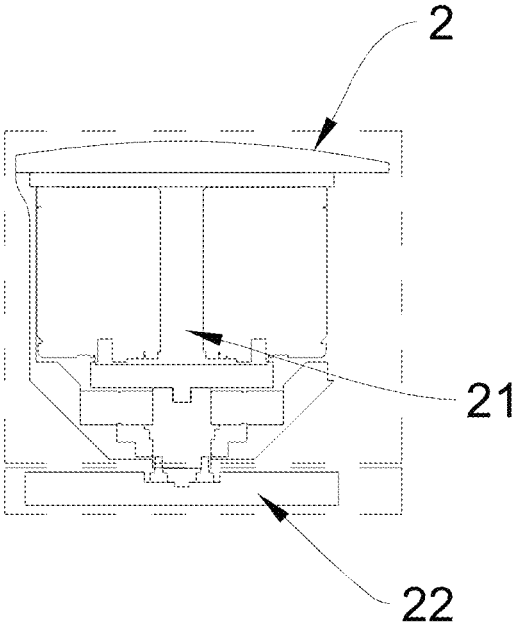
FIG. 10 is the sectional view along D-D in FIG. 9.

As shown in FIG. 9 and FIG. 10, the finishing head unit 2 functions an actuator in the finishing process and comprises a driving unit 21 and a finishing blade 22, and the finishing blade 222 is driven by the driving unit 21 to vertically move up and down and rotates to finish the polishing pad.

As shown in FIG. 3, the base unit 3 is connected to the swing unit 4, the swing unit 4 is connected to a fixing seat 5 and drives the base unit 3, the connecting arm 1 and the finishing head unit 2 to swing circumferentially as a whole to finish all portions of the polishing pad.

The above specific embodiments are used for explaining the present invention, and are not intended to limit the present invention. Any modifications and transformations made to the present invention based on the spirit of the present invention and within the protection scope of the claims should fall within the protection scope of the present invention.

What is claimed is:

1. A polishing pad conditioning apparatus, comprising:

a connecting arm extending horizontally;

a finishing head unit arranged at one end of the connecting arm and used for finishing a polishing pad; and a base unit arranged at the other end of the connecting arm, movably connected to the connecting arm and used for driving the connecting arm to drive the finishing head unit to vertically move up and down, so that the finishing head unit is close to or far away from the polishing pad in a direction tending to be perpendicular to the polishing pad, wherein the base unit at least comprising:

a mounting base:

a connector capable of vertically moving up and down with respect to the mounting base and connected to the connecting arm;

a movable connecting plate connected to the connecting arm and driven by the connecting arm to vertically move up and down along the mounting base; and an adjusting assembly, wherein the adjusting assembly penetrates through the connecting arm to abut against a top surface of the movable connecting plate to adjust a clearance between the connecting arm and the movable connecting plate so as keep the connecting plate horizontal.

2. The polishing pad conditioning apparatus according to claim 1, wherein the connecting arm horizontally drives the finishing head unit to vertically move up and down.

3. The polishing pad conditioning apparatus according to claim 1, wherein the finishing head unit vertically moves up and down to be in surface contact with the polishing pad and keeps in surface contact with the polishing pad to finish the polishing pad.

4. The polishing pad conditioning apparatus according to claim 1, wherein the adjusting assembly comprises at least two first adjusting pieces, the first adjusting pieces are arranged at intervals in a length direction of the connecting arm, and the at least two first adjusting pieces work together to form a first angle between the connecting arm and the movable connecting plate to prevent the connecting arm from inclining upward in the length direction.

5. The polishing pad conditioning apparatus according to claim 4, wherein the adjusting assembly further comprises at least two second adjusting pieces, the second adjusting pieces are arranged at intervals in a width direction of the connecting arm, and the at least second adjusting pieces work together to form a second angle between the connecting arm and the movable connecting plate to prevent the connecting arm from inclining upward in the width direction. The polishing pad conditioning apparatus according to claim 1, wherein the adjusting assembly comprises at least two first adjusting pieces, the first adjusting pieces are arranged at intervals in a length direction of the connecting arm, and the at least two first adjusting pieces work together to form a first angle between the connecting arm and the movable connecting plate to prevent the connecting arm from inclining upward in the length direction.

6. The polishing pad conditioning apparatus according to claim 4, wherein the first adjusting pieces and the second adjusting pieces are arranged perpendicularly.

7. The polishing pad conditioning apparatus according to claim 6, wherein a total number of the first adjusting pieces and the second adjusting pieces is six, and the first adjusting pieces and the second adjusting pieces are divided in two groups which are symmetrically arranged with respect to a central axis of the connecting arm.

8. The polishing pad conditioning apparatus according to claim 5, wherein the connecting arm and the movable connecting plate are connected by means of fasteners, and the fasteners are close to the first adjusting pieces and the second adjusting pieces.

9. The polishing pad conditioning apparatus according to claim 1, wherein a guide mechanism extending vertically is arranged on the mounting base, and the movable connecting plate vertically moves up and down along the guide mechanism.

10. The polishing pad conditioning apparatus according to claim 9, wherein the guide mechanism and the finishing head unit are arranged on two sides of the mounting base respectively.

11. The polishing pad conditioning apparatus according to claim 8, wherein stop blocks are formed at upper and lower ends of the guide mechanism respectively to limit upward and downward moving distances of the movable connecting plate.

12. The polishing pad conditioning apparatus according to claim 1, wherein the connector and the movable connecting plate are arranged separately; or, the connector and the movable connecting plate are configured as an integrated structure.

13. The polishing pad conditioning apparatus according to claim 1, wherein the connector is driven by a power mechanism to move up and down, and a motion clearance is formed between the connector and the power mechanism;

or, the connector and the power mechanism are connected integrally.

14. The polishing pad conditioning apparatus according to claim 13, wherein the power mechanism is a cylinder.

15. The polishing pad conditioning apparatus according to claim 1, wherein a cover having a bottom provided with an opening is formed at an end of the connecting arm, and the connector and the movable connecting plate are connected to an inner top surface of the cover; and hollow portions are formed in a top surface of the cover.

16. The polishing pad conditioning apparatus according to claim 1, wherein the finishing head unit comprises a driving unit and a finishing blade.

17. The polishing pad conditioning apparatus according to claim 1, wherein the base unit being connected to a swing unit, the swing unit being connected to a fixing seat and used for driving the base unit, the connecting arm and the finishing head unit to swing circumferentially as a whole.

* * * * *